US011441290B2

(12) United States Patent
Thomas

(10) Patent No.: US 11,441,290 B2
(45) Date of Patent: Sep. 13, 2022

(54) QUICK-HITCH FOR CONSTRUCTION VEHICLE TOOLS

(71) Applicant: Kinshofer GmbH, Waakirchen (DE)

(72) Inventor: Friedrich Thomas, Schliersee (DE)

(73) Assignee: Kinshofer GmbH, Holzkirchen (DE)

( * ) Notice: Subject to any disclaimer, the term of this patent is extended or adjusted under 35 U.S.C. 154(b) by 361 days.

(21) Appl. No.: 16/729,836

(22) Filed: Dec. 30, 2019

(65) Prior Publication Data

US 2020/0308802 A1 Oct. 1, 2020

(30) Foreign Application Priority Data

Mar. 27, 2019 (DE) ..... 202019101747.3

(51) Int. Cl.
*E02F 3/36* (2006.01)

(52) U.S. Cl.
CPC ..... *E02F 3/3654* (2013.01); *E02F 3/3613* (2013.01); *E02F 3/3618* (2013.01); *E02F 3/3631* (2013.01)

(58) Field of Classification Search
CPC ..... E02F 3/3654; E02F 3/3613; E02F 3/3618; E02F 3/3631
See application file for complete search history.

(56) References Cited

U.S. PATENT DOCUMENTS

| | | | | |
|---|---|---|---|---|
| 6,813,851 | B2 * | 11/2004 | Mieger | E02F 9/2267 37/417 |
| 2002/0157287 | A1 * | 10/2002 | Mieger | E02F 3/3654 37/468 |
| 2010/0183417 | A1 * | 7/2010 | Martin | E02F 3/3654 414/723 |
| 2015/0211206 | A1 * | 7/2015 | Otto | E21B 7/022 173/184 |
| 2020/0291599 | A1 * | 9/2020 | Marchetta | E02F 3/3663 |
| 2022/0018087 | A1 * | 1/2022 | Iwamoto | E02F 9/0841 |

FOREIGN PATENT DOCUMENTS

| | | | |
|---|---|---|---|
| DE | 102004014824 | B4 | 10/2005 |
| DE | 102004015471 | A1 | 10/2005 |
| DE | 102006023420 | A1 | 11/2007 |
| DE | 202012007124 | U1 | 7/2012 |
| DE | 202014001328 | U1 | 5/2015 |
| EP | 1239087 | A1 | 9/2002 |
| EP | 1852555 | A2 | 11/2007 |
| EP | 2018456 | B1 | 1/2009 |
| WO | 2005093172 | A1 | 10/2005 |
| WO | 2018074937 | A1 | 4/2018 |

* cited by examiner

*Primary Examiner* — Jamie L McGowan
(74) *Attorney, Agent, or Firm* — Troutman Pepper Hamilton Sanders LLP; Ryan A. Schneider; Korbin Blunck

(57) ABSTRACT

A quick-hitch for coupling a tool to an excavator arm or a similar tool manipulator includes two hitch halves that can be latched together, coupled to one another at a first pair of latching parts, and pivoted together, about the coupled first pair of latching parts, into a coupling position in which a second pair of latching parts of the hitch halves can be latched. Energy coupling parts are provided on and a coupling carrier is attached to each of the two hitch halves.

23 Claims, 9 Drawing Sheets

QUICK-HITCH FOR CONSTRUCTION VEHICLE TOOLS

CROSS REFERENCE TO RELATED APPLICATION

This application claims the benefit of and priority to German utility model DE 202019101747.3, filed Mar. 27, 2019, which the entire contents are incorporated by reference for all purposes.

TECHNICAL FIELD

The present invention relates to a quick-hitch for coupling a tool to an excavator arm or a similar tool manipulator, comprising two hitch halves that can be latched together and that can be coupled to one another at a first pair of latching parts and can be pivoted together, about the coupled first pair of latching parts, into a coupling position in which a second pair of latching parts of the hitch halves can be latched, wherein energy coupling parts are provided on each of the two hitch halves, which energy coupling parts move together when the hitch halves are pivoted together about the mentioned first pair of latching parts, wherein a coupling carrier is attached to each of the hitch halves, which coupling carrier carries a plurality of energy coupling parts in each case.

BACKGROUND

Quick couplings for coupling various tools, such as rakers, clamshell buckets or demolition claws, to an excavator arm or similar tool guides such as articulated arm jibs, are often used on construction vehicles such as hydraulic excavators, or articulated grabbers such as wood handling machines or demolition devices, or similar material handling machines, in order to be able to use different tools without long retooling times.

As latching elements, quick couplings of this kind can in particular comprise two mutually spaced latching shafts on one coupling part, while the other coupling part, in particular the coupling part on the excavator arm side, can comprise a preferably hook-shaped coupling receptacle for hooking in a first of the two latching shafts, and a latching receptacle for latching to the second latching shaft. After the first latching shaft has been hooked into the coupling receptacle, the two coupling parts can be pivoted relative to one another, wherein the latching shaft located in the coupling receptacle forms the axis of rotation, such that the second latching shaft is inserted or pivoted into the latching receptacle, where said second latching shaft can then be latched, for example in the manner of an extensible chock, by means of a latching element, such that it is at the same time also no longer possible to move the first latching shaft out of the coupling receptacle. In order to move said latching element, an adjustment actuator that is actuated by external energy is provided, which actuator can for example be designed as a hydraulic cylinder and is typically actuatable by means of hydraulic pressure, from the device.

In this case, said latching shafts on one of the coupling parts can be formed by latching bolts which can extend on the corresponding coupling part, in particular so as to be mutually parallel, wherein it may also be possible, however, for other structural parts of the coupling part, such as protruding lugs, axle journals, engagement stubs in the form of protrusions or recesses, for example in the form of pockets, to be used as the latching part, instead of such bolts, the shape of which parts is matched to the coupling receptacle or the latching receptacle of the other coupling part.

Quick couplings of this kind are also subject to standards with respect to the dimensions and the latching parts, in order to ensure the compatibility of a coupling half used on the excavator arm with various tools on which a coupling half is mounted and which, depending on the tool, may originate from various manufacturers and must be sufficiently compatible with the arm-side coupling half that the two coupling halves can come together and latch. Standardization of this kind is achieved for example in the form of what is known as the S-coupler or the S-standard, which specifies the dimensions and arrangement of the latching elements and receiving jaws and was specified by the Swedish institute Maskinleverantörerna and was last published on 28 May 2010. Said S-coupler comprises, in the manner described above, two mutually parallel transverse bolts as latching parts on one coupling half, while the other coupling half comprises a jaw-like coupling receptacle on one side, and an L-shaped latching receptacle on the other side, on opposing end faces, which receptacles can be locked or closed to form a receptacle which is then also U-shaped or jaw-like, by means of a pair of extensible latching bolts.

Further examples of quick couplings of this kind are known from documents EP 1 852 555 A2, DE 20 2012 007 124 U1 and DE 20 2014 001 328 U1.

SUMMARY

In this case, quick-hitches of this kind are often provided with energy couplings, which can for example comprise hydraulic couplings or electrical power couplings, in order to be able to provide energy to the tool to be coupled, by means of an adjustment actuator that is provided on the second hitch half. For example, rotary motors may be provided on the side of the hitch half that is to be coupled, which motors are hydraulically actuated, in order for it to be possible to rotate the tool about an upright axis. Furthermore, adjustment actuators such as hydraulic cylinders or spindle drives comprising electric motors can also be supplied with energy in this manner.

However, in the mentioned type of quick-hitches, the quick-hitch halves of which are pivoted together about the first latching bolt when this is hooked in, it is not particularly easy to bring together the energy couplings. In particular hydraulic couplings react extremely sensitively if they are not brought together in an exactly flush manner, because the hydraulic pins can then cant or jam in the hydraulic bushings into which they are to be inserted, or can damage the coupling parts. The pivot movement of the two hitch halves causes the energy circuit couplings themselves to be moved into one another on a circular path, which inherently also contains a rotary component or a tilting movement component.

In order to prevent these pivot components or the elements coming together on a circular arc, it has already been proposed to decouple the coupling movement from the pivot movement, and to bring the energy couplings together only when the pivot movement has finished. For example, document EP 20 18 456 B1 disclosed a quick-hitch, the hitch halves of which are pivoted together in the manner mentioned. However, the energy couplings are finally coupled together only when the pivot movement has finished, and the second pair of latching parts are latched together. Specifically, the energy couplings are pressed together in a force-locking manner, when the second latching parts pair latches. For this purpose, a latch part that is to be moved has a wedge or sloping surface which, when the latch part is displaced, presses the energy couplings upwards, onto the mating coupling pieces, by means of the wedge action. However, pressing the energy coupling parts against one another in a force-locking manner stresses said parts fairly significantly and can lead to premature wear. In particular, the vibrations arising during rough construction site operation result in micromovements between the energy coupling parts, leading to continuous wear as a result of the force-locking bracing of the energy coupling parts. At the same time, the wedge surface that pushes the energy coupling parts together is itself subject to corresponding wear. As a result, impurities on said wedge surface can lead to the sensitive energy couplings being pushed against one another too firmly.

Furthermore, it has also already been proposed that the problem of the circular path movement should be alleviated by the energy couplings being arranged on a coupling carrier which can tilt relative to the relevant quick-hitch half, specifically about a tilting axis that extends in parallel with the pivot axis of the two quick-hitch halves. In order to actually compensate for the rotary components of the circular path movement upon coupling, the coupling carrier is guided, with respect to the orientation thereof, by separate guide bolts that are inserted into associated guide holes, in order to couple the energy circuit couplings themselves in a manner having an exact linear movement relative to one another. However, exact linear guidance of this kind can be achieved only with a high degree of complexity and allows for no, or only the very smallest, manufacturing tolerances, as a result of which the quick-hitch is expensive to produce. Furthermore, the energy coupling parts react sensitively to wear of said separate guide bolts and holes. When said guide bolts and holes no longer engage with one another in an exactly clearance-free manner, the mentioned canting problem occurs again at the energy coupling parts and can result in damage or even destruction thereof.

The object of the present invention is therefore that of providing an improved quick-hitch of the type mentioned, which overcomes the disadvantages of the prior art and develops said prior art in an advantageous manner. In particular, reliable coupling of the energy coupling parts when the quick-hitch halves are pivoted together is intended to be made possible, which coupling is low-wear even in the case of large manufacturing tolerances, and does not require any complicated mechanics for pressing or separately actuating the energy circuit couplings.

The stated object is achieved according to the invention by a quick-hitch according to claim 1. Preferred embodiments of the invention can be found in the dependent claims.

It is thus proposed for the energy coupling parts to find each other and orientate themselves with one another when the hitch halves are pivoted together, such that the energy coupling parts move into one another in a precisely fitting manner, despite the circular path movement caused by pivoting together the hitch halves. It is furthermore proposed for the energy coupling parts to be designed so as to be self-centering, wherein at least one of the coupling carriers is mounted on the associated hitch half thereof by means of a rubber-elastic carrier bearing so as to be resiliently tiltable in a multiaxial manner, and at least one energy coupling part of each energy coupling part pair that is to be moved together is mounted on the associated coupling carrier by means of a rubber-elastic coupling part bearing so as to be resiliently tilted in a multiaxial manner.

The self-centering of the energy coupling parts with respect to one another makes it possible for the error source of manufacturing tolerances between separate guide bolts/holes and the energy coupling parts to be eliminated, such that the energy coupling parts orient themselves more precisely, relative to one another. If the rotary component of the circular path movement is compensated by means of separate guide bolts and holes, tolerances of position and angle between the guide bolts and holes on the one hand and the energy coupling parts on the other hand result in canting of the energy coupling parts relative to one another. Therefore, the self-alignment of the energy coupling parts relative to one another surprisingly leads to less wear.

In this case, the multi-stage rubber-elastic bearing of the energy coupling parts allows for particularly smooth self-alignment which compensates the rotary components of the circular path movement, wherein the rubber-elastic bearings promote finding of the energy coupling parts and, as a result of the rubber-elastic actuating forces, reduce canting or the tendency to cant. In this case, the rubber-elastic bearing of the coupling carrier allows, in a first stage, for orientation of all the energy coupling parts of one hitch half relative to the energy coupling parts of the other hitch half. Since a plurality of coupling part pairs must find each other, the rubber-elastic bearing of the overall coupling carrier allows for a type of pre-centering. The rubber-elastic bearings, which additionally allow for tilting of individual energy coupling parts relative to the associated coupling carrier, bring about additional fine adjustment, relative to one another, of the two energy coupling parts that find each other in each case, wherein at the same time tolerances of position and/or angle of the energy coupling parts mounted on a common coupling carrier can be compensated. If for example two energy coupling pins are not oriented so as to be exactly mutually parallel, on a coupling plate, even in the case of tilting of the coupling plate this would result in jamming or wear-promotion of the plug-in movement of the two coupling pins in the energy coupling sleeve on the other hitch half. The additional rubber-elastic bearings which allow the energy coupling parts to tilt relative to the coupling carrier can compensate for such shape tolerances or tolerances of position and angle.

In principle, the two coupling carriers can in each case be mounted in a rubber-elastic manner on the two hitch halves, such that each coupling carrier can tilt resiliently in a multiaxial manner relative to the hitch half thereof. In an advantageous development of the invention, however, it is possible for only one of the coupling carriers to be mounted in a rubber-elastic manner on the hitch half thereof, while the coupling carrier on the other hitch half may be rigidly fastened. Unexpectedly, the self-centering of the energy coupling parts relative to one another functions better if only one of the two coupling carriers can tilt resiliently, wherein it may be assumed here that, in the case of rubber-elastic mounting of both coupling carriers, on both sides, simultaneous tilting of both coupling carriers can result in the pivot movement path being over-compensated or the energy coupling parts canting more significantly if both coupling carriers tilt in the same direction.

The rubber-elastic bearings which allow for tilting of the energy coupling parts relative to the coupling carrier can in particular be provided at least on the energy coupling parts which are mounted on the coupling carrier that is itself mounted in a rubber-elastic manner.

In a development of the invention, the mentioned rubber-elastic bearings that allow for tilting of the energy coupling parts relative to the coupling carrier are provided on all the energy coupling parts on both hitch halves. Accordingly, the energy coupling parts on one hitch half can tilt relative to the coupling carrier that is rigidly mounted there. At the same time, the energy coupling parts on the other hitch half can also tilt relative to the coupling carrier that is itself tiltably mounted.

The mentioned energy coupling parts can in particular form coupling plugs that can be plugged into one another. In this case, a coupling plug pair that can be plugged into one another can advantageously comprise a coupling pin and a coupling sleeve, into which said coupling pin can be plugged.

In a development of the invention, the mentioned energy coupling parts can form hydraulic coupling parts in order to be able to convey pressurized fluid away via the two hitch halves. Alternatively or in addition, however, it is also possible for at least one electrical energy coupling part pair to be provided.

In a development of the invention, the self-centering design of the energy coupling parts can comprise a lead-in chamfer on at least one energy coupling part of a pair of energy coupling parts to be coupled. If coupling pins and coupling sleeves that can be plugged into one another in the above-mentioned manner are provided, a lead-in chamber can be formed in particular on the end-face edge of the coupling sleeve.

Alternatively or in addition, however, it would also be possible to provide a lead-in chamber at the end-face end of a coupling pin.

With the exception of the lead-in chamfer, said coupling pins and sleeves can be contoured so as to be in particular at least approximately cylindrical.

In this case, said lead-in chamfer can in principle be contoured differently, for example have cup-shaped curve course. In particular, said lead-in chamfer can have a conical contour. If the relevant energy coupling part is considered in a longitudinal sectional view, the lead-in chamfer can have a straight flank profile.

In an advantageous development of the invention, the lead-in chamfer can be designed having a taper angle of 2 times 20° to 2 times 60° or 2 times 30° to 2 times 50°.

In an advantageous development of the invention, the energy coupling parts are not pushed together in a force-locking manner in the position when coupled together, but instead maintain a certain axial clearance in order not to experience any wear-promoting micromovements as a result of vibrations occurring during operation.

In order to prevent high hydraulic pressure from pushing apart the two energy coupling parts, in the case of hydraulic coupling parts, a securing or latching means that operates in an interlocking manner can be provided, which prevents the rubber-elastic bearings from being pushed apart and/or being overloaded. In particular a latching means that can be latched in an interlocking manner can be provided which, in the normal operating situation when the energy coupling parts are closed, exhibits clearance and allows the energy coupling parts a certain degree of freedom of movement.

In a development of the invention, such a latching means that operates only in an interlocking manner can comprise a displaceable latch which displaceably mounted on a quick-hitch half, for example on the coupling carrier provided there, wherein the displaceability can be provided in a plane perpendicular to the direction of the coupling movement of the energy coupling parts that move into one another.

Said displaceable latch can be latched and/or unlatched by means of an adjustment actuator, for example in the form of a pressure medium cylinder.

In an advantageous development of the invention, the latching means can be designed so as to be self-opening, in particular such that the latching means falls into the lock by itself, irrespective of the current state and/or the current position thereof, and/or is optionally pushed open when the hitch halves are pivoted together and/or when the energy coupling parts are moved together, if the latching part is in the closed position. Such a self-opening design of the latching means prevents the latching means from preventing the energy coupling parts from moving together if the latching means was inadvertently not in the open position when the energy coupling parts are moved together.

Such a self-opening design of the latching means can advantageously be achieved by means of a displaceable latch and/or a detent that is to be latched comprising a lead-in chamfer which exerts a wedge action on the displaceable latch part and pushes the displaceable latch part when said chamfer runs onto the mating surface.

In an advantageous development of the invention, the latching means can comprise a plurality of preferably mushroom-shaped latching pins which are oriented approximately in the direction of the circular arc path and the mushroom-shaped heads of which face forwards when the hitch halves are moved together. The latch part that is complementary to the mushroom-shaped latching pins can be a latching plate in which recesses, preferably in the form of through-holes or open grooves, can be provided, through which the mushroom-shaped latching pins can pass. If the mushroom-shaped heads of the mushroom-shaped latching pins have passed through the recess, the latch part can move transversely to the insertion direction of the latching pins and engage below the mushroom-shaped heads.

BRIEF DESCRIPTION OF THE FIGURES

The invention will be explained in greater detail in the following, with reference to a preferred embodiment and accompanying drawings. In the drawings:

FIG. 3*a* shows the hitch half which is mounted on the excavator arm and on which a coupling carrier is rigidly mounted, and partial view FIG. 3*b* shows a tool-side hitch half on which a coupling carrier is mounted in a rubber-elastic manner.

DETAILED DESCRIPTION

Figure 1:
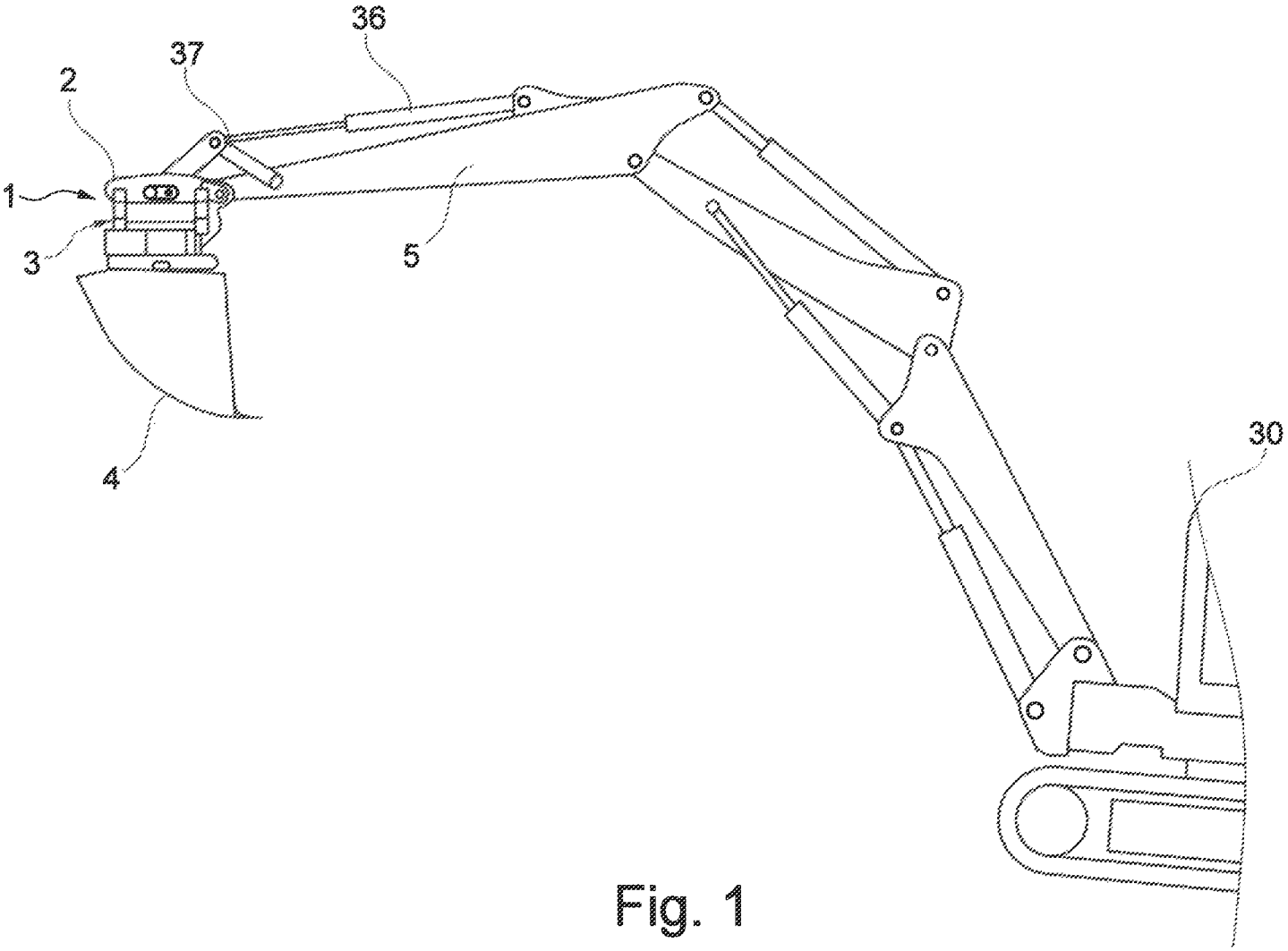
FIG. 1: is a schematic side view of a quick-hitch according to an advantageous embodiment of the invention, which quick-hitch is attached to a jib arm of an excavator and a grab bucket is coupled as an add-on tool.

As shown in FIG. 1, the quick-hitch 1 can be mounted between the free end of the jib arm 5 of an excavator 30 and the tool 4 that is to be attached thereto, wherein said add-on tool 4 can be designed for example as a grab bucket, as is shown in FIG. 1, but which can, in a manner conventional per se, also comprise other construction, handling or demolition tools, for example in the form of clamshell buckets, demolition jaws, pincers, or the like.

In this case, said quick-hitch 1 can be able to be mounted on said jib arm 5, by means of an arm-side hitch half 2, so as to be pivotable about a horizontal pivot axis that is oriented transversely to the longitudinal axis of the jib arm 5, such that the quick coupling 1, together with the tool 4 attached thereto, can be pivoted relative to the jib arm 5 for example by means of a pressure medium cylinder 36 and an interposed pivot piece 37.

A tool-side hitch half 3 (cf. FIG. 2) can be attached to the add-on tool 4 and/or an interposed rotary drive.

Figure 2:
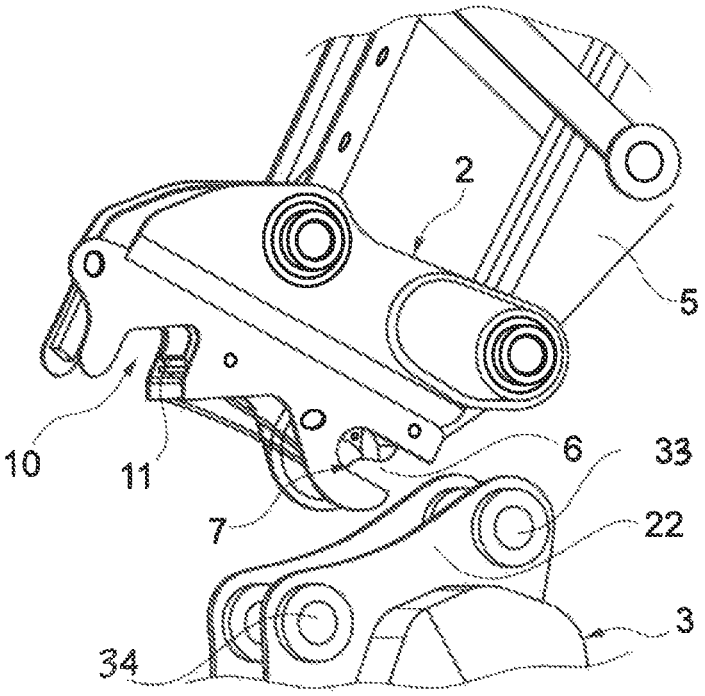
FIG. 2: is a perspective view of the quick-hitch from FIG. 1 in an uncoupled position in which the two hitch halves that can be coupled together are shown shortly before being hooked onto the hook portion.
Figure 3A:
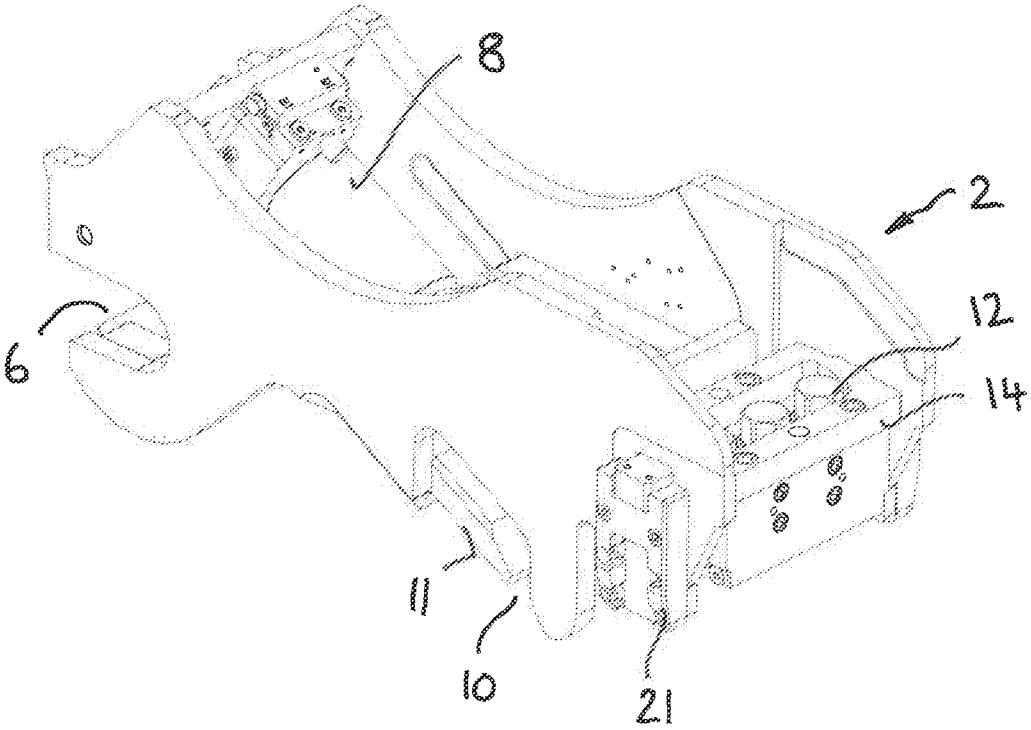
FIGS. 3*a* and 3*b*: are each a perspective view of the two hitch halves, showing energy coupling parts attached to each hitch half, wherein partial view
Figure 3B:
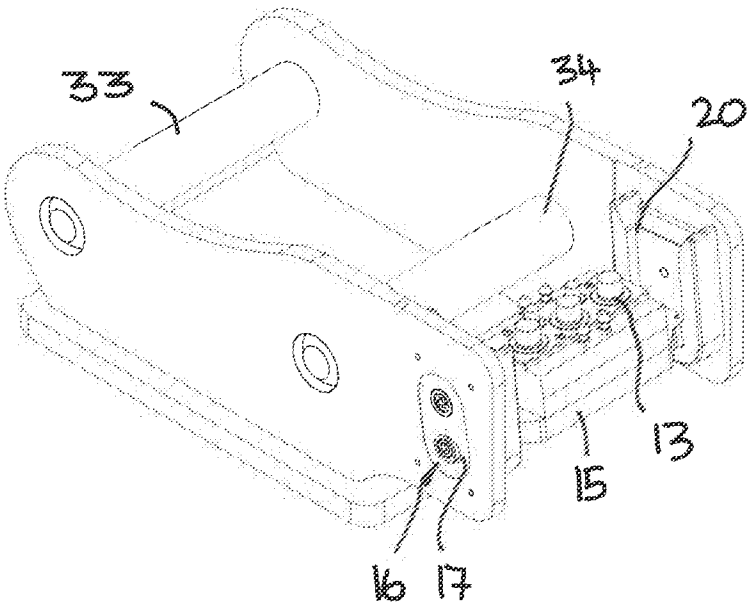

As shown in FIG. 2, the two hitch halves 2 and 3 comprise two pairs of latching parts that can be latched together and that allow for a two-stage coupling or latching process. Firstly, one pair of latching elements is hooked in or coupled, in order to then pivot the two hitch halves together about the coupled first latching pair. In the pivoted-together coupling position, the second pair of latching parts are then latched together, cf. a comparison of FIGS. 4 and 5.

As shown in FIG. 2, one hitch half, in particular the arm-side hitch half 2, can comprise, as latching parts, a coupling receptacle 6 and a displaceable latch 11 that can be moved in front of the opening of a latching receptacle 10, wherein said latching receptacle 10 can have a different opening direction from the coupling receptacle. In particular, the coupling receptacle 6 can be open in the direction facing away from the latching receptacle 10, while the latching receptacle 10 can be designed so as to be open towards the other hitch half 3. However, as an alternative to the embodiment shown in the figures, according to FIG. 2, the second latching part of the hitch half 2 could also comprise a latching jaw that is displaceable as a whole, as is known per se. The latch 11 can be displaceable approximately in a direction transversely to the opening of the latching receptacle 10, in order to be able to be pushed in front of said opening. For example, the latch 11 can be moved into the latching receptacle 10 from above, so as to be slightly obliquely inclined.

The other hitch half, in particular the tool-side hitch half 3, can comprise two transverse bolts 33 and 34 as latching parts which can be oriented so as to be in parallel with one another and mutually spaced to such an extent that they fit into the openings of the coupling and latching receptacles 6 and 10.

In order to couple the two hitch halves 2 and 3 together, firstly the coupling receptacle 6 is suspended on the transverse bolt 33, wherein a securing element 7 can capture or secure the transverse bolt 33 in the coupling receptacle 6 in order to prevent said bolt from inadvertently slipping out when the two hitch halves 2 and 3 are pivoted together. Said securing element 7 can for example be spring-preloaded and opened by a pressure actuator when the quick-hitch is intended to be decoupled.

Figure 4:
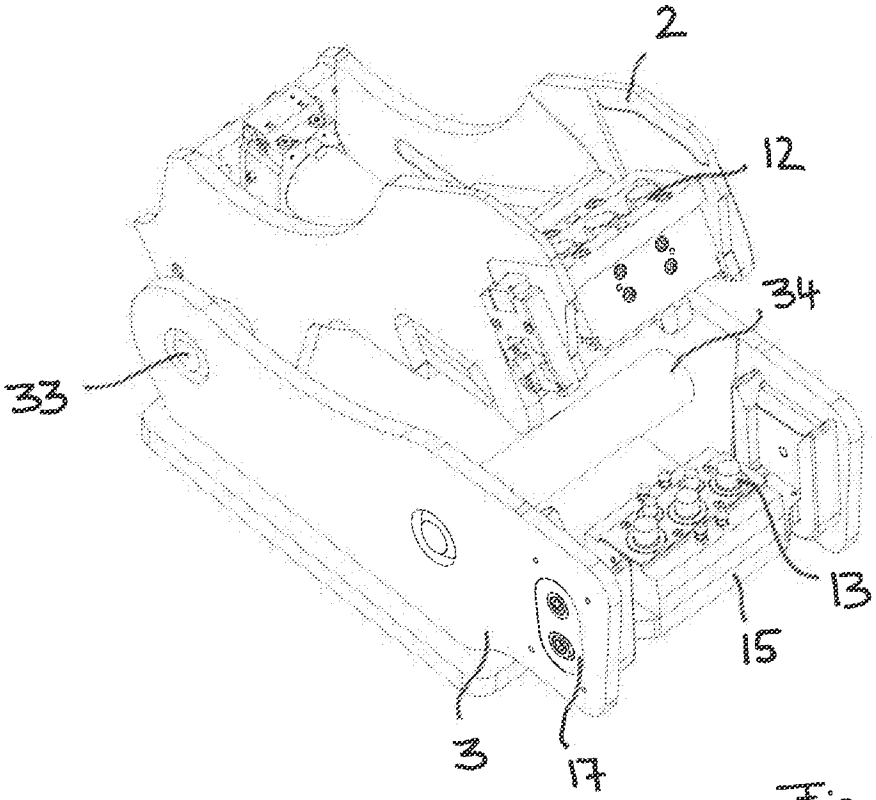
FIG. 4: is a perspective view of the two hitch halves in the state when coupled together but not yet pivoted together.
Figure 5:
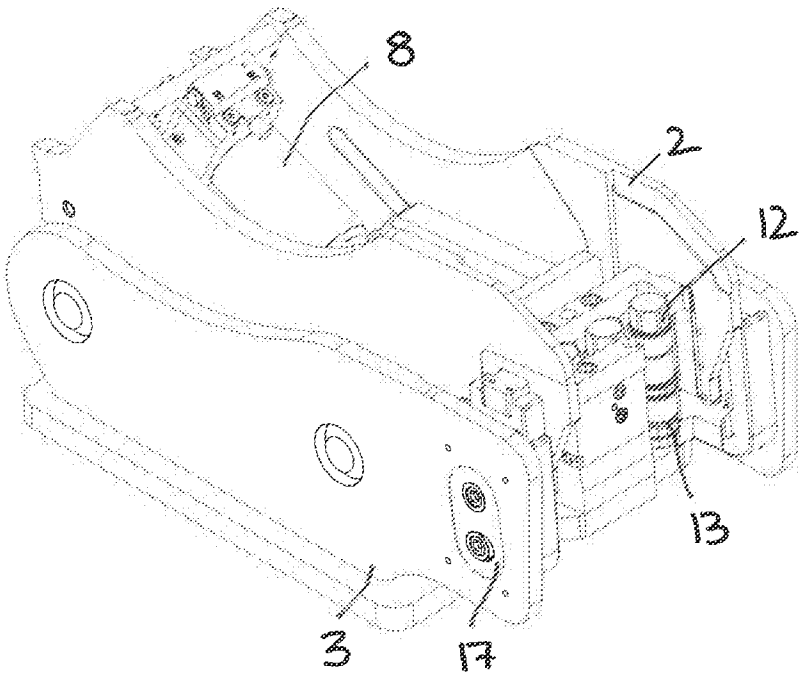
FIG. 5: is a perspective view of the quick-hitch halves that is similar to FIG. 4, wherein the quick-hitch halves have been moved together and the energy coupling parts are coupled.

If the coupling receptacle 6 is suspended on the transverse bolt 33, as is shown in FIG. 4, the two hitch halves 2 and 3 can be pivoted towards one another about the pivot axis formed by the suspended coupling receptacle 6 or the transverse bolt 33 captured therein, as far as the coupling position shown in FIG. 5. In the mentioned coupling position according to FIG. 5, the second transverse bolt 34 is inserted into the latching receptacle 10 such that the latch 11 can be moved into the latching position in order to secure or fix the transverse bolt 34 in the latching receptacle 10. The latch 11 can be actuated by a pressure medium cylinder 8 for example.

As shown in FIGS. 4 and 5, energy coupling parts 12 and 13 are provided on a portion of the hitch halves 2 and 3 that is spaced apart from the coupling receptacle 6, which energy coupling parts can in particular be arranged on an end portion of the hitch halves 2 and 3 that is opposite the coupling receptacle 6.

Said energy coupling parts 12 and 13 can be hydraulic couplings for example. Irrespective thereof, the energy coupling parts 12 and 13 can be designed as plug-in couplings which can be moved into one another and can comprise coupling sleeves and coupling pins that can be inserted therein; cf. FIG. 7.

In order to mount the energy coupling parts 12 and 13 on the two hitch halves 2 and 3, a coupling carrier 14 and 15 is provided on each hitch half 2 and 3, which coupling carrier 14 and 15 can be designed in the form of a carrier plate for example, on which the energy coupling parts 12 and 13 can be mounted.

Figure 6:
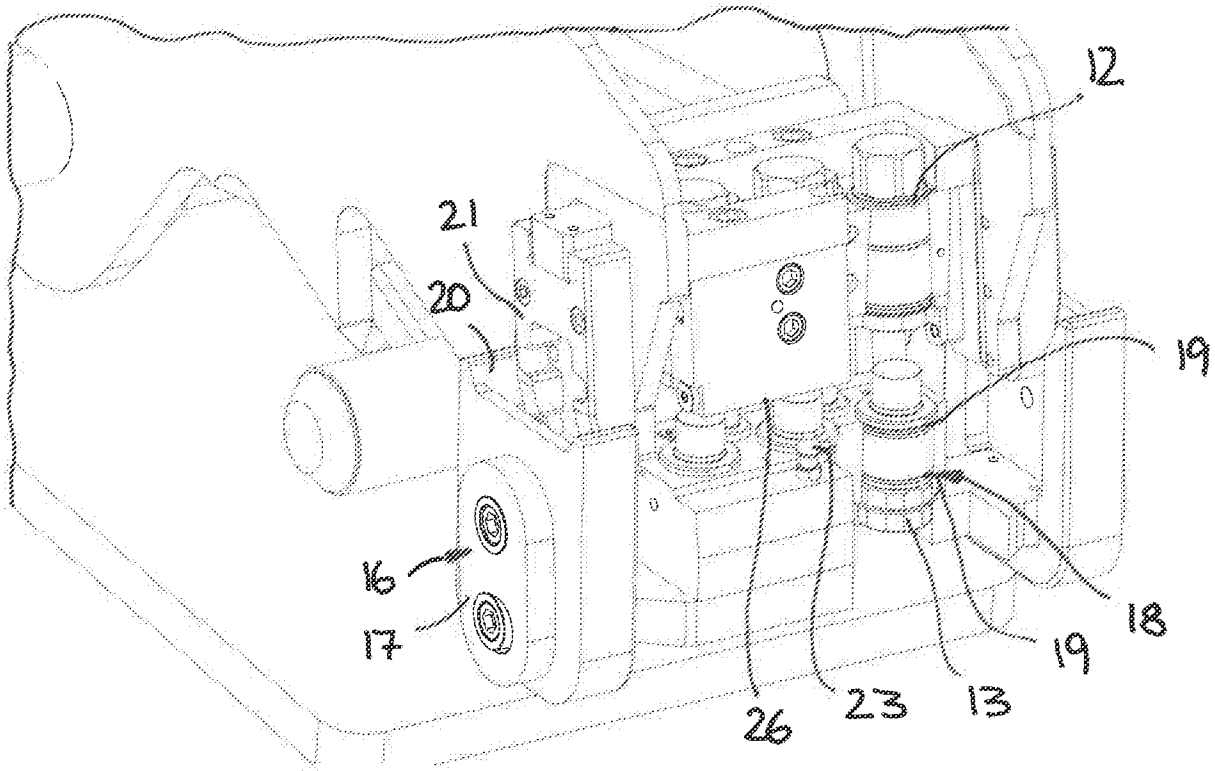
FIG. 6: is a partial perspective view of the energy coupling parts shortly before being coupled together.
Figure 7:
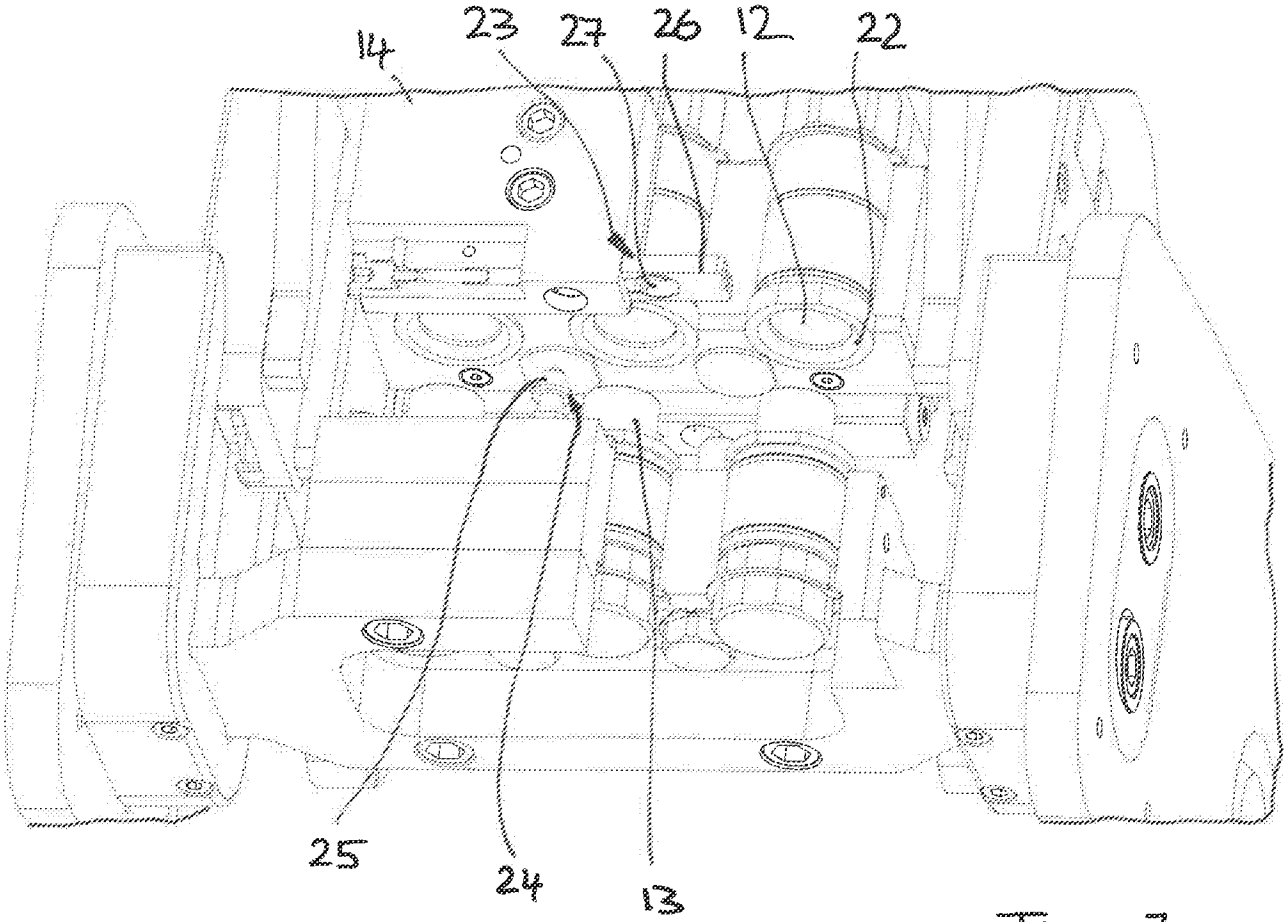
FIG. 7: is a perspective plan view of the energy coupling parts on one hitch half, and an oblique side view of the energy coupling parts on the other quick-hitch half, wherein the two quick-hitch halves are not yet fully pivoted together, wherein the interlocking latching device for latching the energy coupling parts is shown, wherein a transversely displaceable latch comprising recesses is shown on the upper hitch half and the mushroom-shaped latching pins that can be inserted therein are shown on the lower hitch half.

As made clear in FIGS. 6 and 7, the coupling carrier 14 can be rigidly mounted on "its" hitch half, wherein the rigidly mounted coupling carrier 14 can in particular be provided on the arm-side hitch half 2. The other coupling carrier 15 can be mounted on the other hitch half, in particular the tool-side hitch half 3, by means of a rubber-elastic bearing 16, so as to be resiliently tiltable in a multiaxial manner. Said rubber-elastic coupling carrier bearing 16 can advantageously comprise at least one rubber bearing block 17 which is fastened to the hitch half 3 on one side and to the coupling carrier 15 on the other side. Advantageously, two block-shaped or plate-shaped rubber bearing parts 17 can be inserted into recesses of the hitch half 3 which can for example extend transversely to the longitudinal extent of the coupling carrier 15. The coupling carrier 15 is fastened to the rubber bearing parts 17 fastened to the hitch half 3 for example by means of bolts or in another manner, such that the bearing forces can be carried away via the rubber bearing parts 17.

Figure 8:
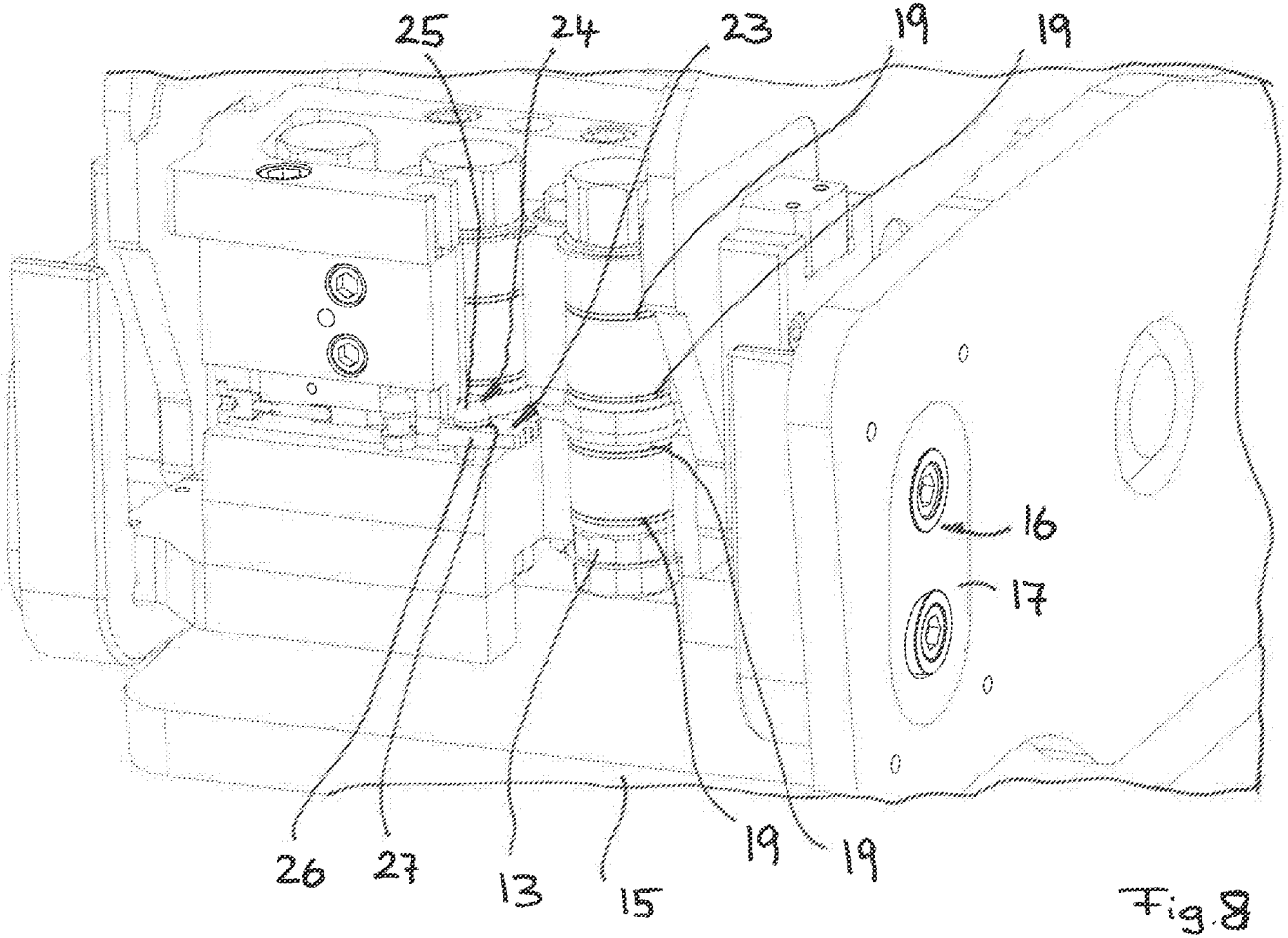
FIG. 8: is a perspective partial view of the latching means of the energy coupling parts, wherein the mushroom-shaped latching pins are inserted into the latching plate and latched, and the clearance present in this case is shown.

As FIGS. 6, 7 and 8 further show, the energy coupling parts 12 and 13 are mounted so as to be movable in themselves and/or relative to the respective coupling carrier 14 or 15 by means of rubber-elastic coupling bearings 18, such that the energy coupling parts 12 and 13 can move relative to the coupling carriers 14 and 15, respectively, thereof, in particular can tilt resiliently in a multiaxial manner.

The rubber-elastic coupling bearings 18 can advantageously comprise a plurality of annular or plate-shaped rubber bearing parts 19 which are connected between adjacent portions of the energy coupling parts 12 and 13 and/or can be provided between the energy coupling parts 12 and 13 on one side and the coupling carriers 14 and 15 on the other side. Said rubber bearing parts 19 can form rubber hinges which allow for multiaxial tilting of the tips or front portions, to be inserted, of the energy coupling parts.

As FIGS. 6 and 7 make clear, entry pockets 20 and protrusions 21 can be provided on the hitch halves 2 and 3, in the vicinity of the energy coupling parts 12 and 13, in order to prevent the energy coupling parts 12 and 13 from moving together in an entirely incorrect relative position. Said entry pockets 20 and protrusions 21 allow for complete pivoting together only if the coupling receptacle 6 has been correctly suspended on the transverse latch 13, and prevents pivoting together if this is not the case. Said entry pockets 20 and protrusions 21 do not form a centering device for the energy coupling parts 12 and 13, and can be rigidly attached to the hitch halves 2 and 3, such that they do not bring about any tilting of the energy coupling parts 12 and 13 relative to the hitch halves 2 and 3. Said entry pockets 20 and protrusions 21 are effective before the energy coupling parts 12 and 13 come into engagement, and have sufficient clearance relative to one another that they do not bring about any pre-centering.

Specifically, the energy coupling parts 12 and 13 center themselves, relative to one another. The self-centering design of the energy coupling parts 12 and 13 comprises lead-in chamfers 22 at the end-face edges of the sleeve-like coupling parts 12, which chamfers may be designed for example in the form of a conical lead-in chamfer or a conical insertion funnel. Alternatively or in addition, a corresponding lead-in chamfer, in particular in the form of a conical chamfering, could also be provided on the end-face edges of the coupling pins 13.

If the energy coupling parts 12 and 13 are moved towards one another and into one another on a circular arc path, by means of pivoting together the hitch halves 2 and 3, said lead-in chamfers 22 bring about self-centering of the energy coupling parts 12 and 13 and compensation of the rotary components of the circular arc path.

In this case, the rubber-elastic bearings of the energy coupling parts 12 and 13 and of the coupling carrier 15 allow for tilting of the energy coupling parts 12 and 13 relative to one another and relative to the particular coupling carrier, as well as, by means of the rubber-elastic carrier bearing 16, also overall tilting of all the energy coupling parts 13 on the tool-side coupler part.

The energy coupling parts 12 and 13 are thus coupled together fully and only by means of pivoting together the two hitch halves 2 and 3, wherein the energy coupling parts are moved together at the same time as the pivoting together takes place and before the process of latching the latch 11 onto the latching receptacle 10 has yet been completed.

In order to prevent the energy coupling parts 12 and 13 from moving apart undesirably, under high hydraulic pressure, an interlocking latching device 23 can be provided which latches the two coupling carriers 14 and 15 in an interlocking manner and prevents said carriers from moving apart. As shown most clearly in FIG. 7 and FIG. 8, the latching device 23 comprises latching pins 24 comprising a head 25 designed in an undercut manner, which pins can be inserted through latching recesses 27 of a displaceable transverse latch 26; cf. FIG. 8. Said head 25 of the latching pins 24 can in particular be formed approximately in a mushroom-shaped manner and/or comprise a chamfered and/or conically contoured lead-in region which enters the latching recesses 27 in each case, in order to optionally push these apart if the transverse latch 26 is not in the open position thereof.

Said transverse latch 26 can be displaced or moved transversely to the insertion direction of the latching pins 24, which can be achieved by means of a suitable actuator, for example in the form of a pressure medium cylinder.

As shown in FIG. 8, there is air or play between the latching pins 24, in particular the undercut heads 25, and the transverse latch 26, such that the energy coupling parts 12 and 13 are not pressed against one another in a frictional manner, but rather merely interlockingly secured if this is required.

What is claimed is:

1. A quick-hitch for coupling a tool to an excavator arm or a similar tool manipulator, comprising two hitch halves that can be latched together and that can be coupled to one another at a first pair of latching parts and can be pivoted together, about the coupled first pair of latching parts, into a coupling position in which a second pair of latching parts of the hitch halves can be latched, wherein energy coupling parts are provided on each of the two hitch halves, an energy coupling part pair formed by a cooperative energy coupling part on each of the two hitch halves being a pair of a male and a female coupling plug to be plugged into one another, which energy coupling parts move together when the hitch halves are pivoted together about the pivot axis formed by said first pair of latching parts, wherein a coupling carrier is attached to each hitch half, which coupling carrier carries a plurality of energy coupling parts in each case, wherein the energy coupling parts are designed so as to be self-centering including centering chamfers on end-face edge portions, wherein at least one of the coupling carriers is mounted on the associated hitch half by means of a rubber-elastic carrier bearing so as to be resiliently tiltable in a multiaxial manner, wherein at least one energy coupling part of each energy coupling part pair that is to be moved together is mounted on the associated coupling carrier by means of a rubber-elastic coupling part bearing so as to be resiliently tiltable in a multiaxial manner, and wherein, when the energy coupling parts of an energy coupling part pair couple into each other by means of pivoting the hitch halves, a rotary component of a circular arc path due to pivoting is compensated solely by means of the self-centering design of the pair of male and female coupling plugs.

2. The quick-hitch of claim 1, wherein the centering chamfers are contoured in the form of centering tapers.

3. The quick-hitch of claim 1, wherein the coupling carrier is rigidly mounted on the hitch half on one hitch half, and the other coupling carrier is mounted on the other hitch half, by means of the rubber-elastic carrier bearing, so as to be resiliently tiltable in a multiaxial manner.

4. The quick-hitch of claim 3, wherein the rubber-elastic carrier bearing comprises two block-shaped or plate-shaped rubber bearing parts which are received in bearing recesses in the hitch half, wherein the coupling carrier is fastened to the two rubber bearing parts by means of opposing end portions.

5. The quick-hitch of claim 3, wherein the rubber-elastic coupling part bearing, by means of which the energy coupling parts can be resiliently tilted in a multiaxial manner relative to the associated coupling carrier, comprises annular or plate-shaped rubber bearing parts which interconnect adjacent portions of the energy coupling parts.

6. The quick-hitch of claim 1, wherein each energy coupling part comprises at least two rubber bearing parts which are arranged so as to be mutually spaced and which each connect two adjacent coupling part portions.

7. The quick-hitch of claim 1, wherein the energy coupling parts are formed as hydraulic couplings.

8. The quick-hitch of claim 1, wherein a latching device that operates exclusively in an interlocking manner is provided for latching the energy coupling parts in the coupled position, which latching device exhibits clearance in the latched position and provides for limited mobility of the energy coupling parts relative to one another.

9. A quick-hitch comprising:

two hitch halves, each comprising:

a latching part of a first pair of latching parts;

a latching part of a second pair of latching parts;

self-centering energy coupling parts; and a coupling carrier carrying two or more of the self-centering energy coupling parts;

a carrier bearing;

a coupling part bearing; and a latching device;

wherein:

the hitch halves are configured to be:

latched together in a latched position;

coupled to one another at the first pair of latching parts;

pivoted together about a pivot axis formed by the coupled first pair of latching parts; and coupled together in a coupled position in which the second pair of latching parts are latched;

the self-centering energy coupling parts of the hitch halves move together when the hitch halves are pivoted together;

at least one of the coupling carriers is mounted on the associated hitch half by means of the carrier bearing so as to be resiliently tiltable in a multiaxial manner;

at least one self-centering energy coupling part of an energy coupling part pair is mounted on the associated coupling carrier by means of the coupling part bearing so as to be resiliently tiltable in a multiaxial manner;

the latching device is configured to:

operate exclusively in an interlocking manner for latching the self-centering energy coupling parts in the coupled position of the hitch halves:

exhibit clearance in the latched position of the hitch halves; and provide for limited mobility of the self-centering energy coupling parts relative to one another;

the latching device comprises a displaceable transverse latch comprising latching recesses on one hitch half, and furthermore comprises latching pins that are mounted on the other hitch half and have undercut heads, the undercut heads of which latching pins can be inserted into the latching recesses of the transverse latch; and the transverse latch can be moved under the undercut heads by means of transverse displacement.

10. The quick-hitch of claim 9, wherein the displaceable transverse latch can be latched and/or unlatched by means of a pressure medium actuator.

11. The quick-hitch of claim 10, wherein the latching heads of the latching pins comprise a conical lead-in chamfer, by means of which the transverse latch can be pressed out of the latched position thereof and into the unlatched position thereof, and the latching pins can be inserted into the latching recesses of the transverse latch.

12. The quick-hitch of claim 9, wherein an energy coupling part pair formed by a cooperative energy coupling part on each of the two hitch halves comprises a pair of a male and a female coupling plug to be plugged into one another.

13. The quick-hitch of claim 12, wherein the self-centering energy coupling parts include centering chamfers on end-face edge portions.

14. The quick-hitch of claim 13, wherein, when the energy coupling parts of an energy coupling part pair couple into each other by means of pivoting the hitch halves, a rotary component of a circular arc path due to pivoting is compensated solely by means of the self-centering design of the pair of male and female coupling plugs.

15. A quick-hitch for coupling a tool to an excavator arm or a similar tool manipulator, comprising two hitch halves that can be latched together and that can be coupled to one another at a first pair of latching parts and can be pivoted together, about the coupled first pair of latching parts, into a coupling position in which a second pair of latching parts of the hitch halves can be latched, wherein energy coupling parts are provided on each of the two hitch halves, which energy coupling parts move together when the hitch halves are pivoted together about the pivot axis formed by said first pair of latching parts, wherein a coupling carrier is attached to each hitch half, which coupling carrier carries a plurality of energy coupling parts in each case, wherein the energy coupling parts are designed so as to be self-centering, wherein at least one of the coupling carriers is mounted on the associated hitch half by means of a rubber-elastic carrier bearing so as to be resiliently tiltable in a multiaxial manner, wherein at least one energy coupling part of each energy coupling part pair that is to be moved together is mounted on the associated coupling carrier by means of a rubber-elastic coupling part bearing so as to be resiliently tiltable in a multiaxial manner, wherein the rubber-elastic coupling part bearing between the coupling carrier and the energy coupling parts mounted thereon, includes annular or plate-shaped rubber-bearing parts forming rubber hinges provided between each of energy coupling parts and the coupling carrier, and wherein the rubber-elastic carrier bearing, between the coupling carrier and the hitch half to which the coupling carrier is mounted, includes block-shaped or plate-shaped rubber bearing parts inserted into recesses of the hitch half, wherein the coupling carrier is fastened to such rubber bearing parts.

16. The quick-hitch of claim 15, wherein the energy coupling parts comprise centering chamfers on end-face edge portions.

17. The quick-hitch of claim 16, wherein the centering chamfers are contoured in the form of centering tapers.

18. The quick-hitch of claim 15, wherein tilting movements of the energy coupling parts for compensating a rotary component of the circular arc path of the energy coupling parts that move towards one another, when the hitch halves are pivoted together, are controlled only by the self-centering of the energy coupling parts.

19. The quick-hitch of claim 15, wherein the coupling carrier is rigidly mounted on the hitch half on one hitch half, and the other coupling carrier is mounted on the other hitch half, by means of the rubber-elastic carrier bearing, so as to be resiliently tiltable in a multiaxial manner.

20. The quick-hitch of claim 15, wherein each energy coupling part comprises at least two rubber bearing parts which are arranged so as to be mutually spaced and which each connect two adjacent coupling part portions.

21. The quick-hitch of claim 15, wherein the energy coupling parts are formed as hydraulic couplings.

22. The quick-hitch of claim 15, wherein a latching device that operates exclusively in an interlocking manner is provided for latching the energy coupling parts in the coupled position, which latching device exhibits clearance in the latched position and provides for limited mobility of the energy coupling parts relative to one another.

23. The quick-hitch of claim 15, wherein the latching device comprises a displaceable transverse latch comprising latching recesses on one hitch half, and furthermore comprises latching pins that are mounted on the other hitch half and have undercut heads, the undercut heads of which latching pins can be inserted into the latching recesses of the transverse latch; and wherein the transverse latch can be moved under the undercut heads by means of transverse displacement.

* * * * *